US005612175A

United States Patent [19]

Eshelman et al.

[11] Patent Number: 5,612,175

[45] Date of Patent: Mar. 18, 1997

[54] EPITAXIALLY SENSITIZED TABULAR GRAIN EMULSIONS EXHIBITING ENHANCED SPEED AND CONTRAST

[75] Inventors: Lyn M. Eshelman, Penfield; Paul J. Madigan, Rochester; Joseph C. Deaton, Rochester; David A. Dumont, Rochester; Michael G. Antoniades, Rochester; Sharon G. Johnston, Rochester, all of N.Y.

[73] Assignee: Eastman Kodak Company, Rochester, N.Y.

[21] Appl. No.: 592,169

[22] Filed: Jan. 26, 1996

[51] Int. Cl.[6] ..... G03K 1/035

[52] U.S. Cl. ..... 430/567; 430/570; 430/581

[58] Field of Search ..... 430/567, 570, 430/581

[56] References Cited

U.S. PATENT DOCUMENTS

| | | | |
|---|---|---|---|
| 4,435,501 | 3/1984 | Maskasky | 430/434 |
| 4,439,520 | 3/1984 | Kofron et al. | 430/434 |
| 5,250,403 | 10/1993 | Antoniades et al. | 430/505 |
| 5,494,789 | 2/1996 | Daubendiek et al. | 430/567 |

*Primary Examiner*—Mark F. Huff

*Attorney, Agent, or Firm*—Carl O. Thomas

[57] ABSTRACT

A radiation-sensitive spectrally sensitized tabular grain emulsion is disclosed which exhibits improved speed and contrast. The tabular grains have {111} major faces, contain greater than 70 mole percent bromide and up to 10 mole percent iodide, based on silver, account for greater than 90 percent of total grain projected area, and have an average equivalent circular diameter of at least 3.5 μm. The tabular grains have latent image forming chemical sensitization sites on their surfaces including epitaxially deposited silver halide protrusions of a face centered cubic rock salt crystal lattice structure forming epitaxial junctions with the tabular grains. The protrusions are restricted to those portions of the tabular grains located nearest peripheral edges of and accounting for less than 10 percent of the {111} major faces of the tabular grains, accounting for less than 5 percent of total silver forming the tabular grains and protrusions, containing a silver chloride concentration at least 10 mole percent higher than that of the tabular grains, and contain at least 1 mole percent iodide, based on silver in the protrusions.

16 Claims, No Drawings

EPITAXIALLY SENSITIZED TABULAR GRAIN EMULSIONS EXHIBITING ENHANCED SPEED AND CONTRAST

FIELD OF THE INVENTION

The invention relates to silver halide photography. More specifically, the invention relates to spectrally sensitized silver halide emulsions.

DEFINITION OF TERMS

In referring to silver halide grains or emulsions containing two or more halides, the halides are named in order of ascending concentrations.

The term "high bromide" in referring to silver halide grains and emulsions is employed to indicate greater than 70 mole percent bromide, based on total silver forming the grains or emulsions.

The "equivalent circular diameter" (ECD) of a grain is the diameter of a circle having an area equal to projected area of the grain.

The "aspect ratio" of a silver halide grain is the ratio of its ECD divided by its thickness (t).

The term "tabular grain" is defined as a grain having an aspect ratio of at least 2.

The term "tabular grain emulsion" is defined as an emulsion in which at least 50 percent of total grain projected area is accounted for by tabular grains.

The term "large" in referring to tabular grains refers to those having a mean ECD of at least 3.5 μm.

The terms "thin" and "ultrathin" in referring to tabular grains and tabular grain emulsions indicates a mean tabular grain thickness of less than 0.2 and 0.07 μm, respectively.

The term "{111} tabular" in referring to tabular grains and emulsions is employed to indicate that the tabular grains have major faces that lie in {111} crystal lattice planes.

The term "coefficient of variation" (COV) is defined as 100 times the standard deviation of grain ECD divided by mean grain ECD.

The term "epitaxy" is employed in its art recognized usage to indicate a crystalline form having its orientation controlled by that of another crystalline form serving as a substrate for its deposition.

*Research Disclosure* is published by Kenneth Mason Publications, Ltd., Dudley House, 12 North St., Emsworth, Hampshire P010 7DQ, England.

BACKGROUND

Kofron et al U.S. Pat. No. 4,439,520 ushered in the current era of high speed, high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed. The most highly controlled site depositions (e.g., corner specific epitaxy siting) and the highest photographic speeds reported by Maskasky I were obtained by epitaxially depositing silver chloride onto silver iodobromide tabular grains. Maskasky I taught a preference for epitaxially depositing a silver salt having a higher solubility than the host tabular grains, stating that this reduces any tendency toward dissolution of the tabular grains while silver salt is being deposited. Maskasky I recognized that even when chloride is the sole halide run into a tabular grain emulsion during epitaxial deposition, a minor portion of the halide contained in the host tabular grains can migrate to the silver chloride epitaxy. However, the concentration in the epitaxy of any halide derived solely from the host tabular grain cannot be higher in the epitaxy than it is in the adjacent portion of the host tabular grain.

While Kofron et al and Maskasky I both acknowledged the possibility of very large average tabular grain sizes, ranging up to 10, 20 or even 30 micrometers (μm), in fact, no Examples of emulsions having mean grain sizes as large as 10 μm were reported by Kofron et al or Maskasky I, and for the most part their Examples of tabular grain emulsions exhibited mean ECD's of ≦3.0 μm. This preference for tabular grain emulsions having mean ECD's of ≦3.0 μm has continued up until this invention. Further, the art has recognized that the photographic speeds of tabular grain emulsions reach a maximum at a mean ECD of approximately 5 μm and cannot be increased by further increasing grain size, resulting instead in only increases in granularity.

One of the primary deterrents to employing large (≧3.5 μm) mean ECD tabular grain emulsions is based on the disadvantage that image contrast declines progressively as mean ECD's are increased.

RELATED PATENT APPLICATIONS

Daubendiek et al U.S. Ser. No. 08/297,145, filed Aug. 26, 1994, and U.S. Ser. No. 08/451,881, filed May 26, 1995, both allowed and commonly assigned, titled ULTRATHIN TABULAR GRAIN EMULSIONS WITH SENSITIZATION ENHANCEMENTS (I) & (II), disclose a radiation-sensitive emulsion comprised of (1) a dispersing medium, (2) silver halide grains including tabular grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of from 0.7 to 10 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the tabular grains contain less than 10 mole percent iodide and the surface chemical sensitization sites include epitaxially deposited silver halide protrusions of a face centered cubic crystal lattice structure of the rock salt type forming epitaxial junctions with the tabular grains, the protrusions (a) being restricted to those portions of the tabular grains located nearest peripheral edges of and accounting for less than 50 percent of the {111} major faces of the tabular grains, (b) containing a silver chloride concentration at least 10 mole percent higher than that of the tabular grains, and (c) including iodide, either at least 1 mole percent or a higher concentration than those portions of the tabular grains extending between the {111} major faces and forming epitaxial junctions with the protrusions.

In Eshelman et al U.S. Ser. Nos. 08/592,251 and 08/592,798, concurrently filed and both commonly assigned, titled HIGH SPEED EMULSIONS EXHIBITING SUPERIOR CONTRAST AND SPEED-GRANULARITY RELATIONSHIPS and HIGH SPEED EMULSIONS EXHIBITING SUPERIOR SPEED-GRANULARITY RELATIONSHIPS, respectively, spectrally sensitized tabular grain emulsions are disclosed exhibiting (1) increased speeds and (2) contrasts and speed-granularity relationships superior to those of conventional emulsions of the same average grain sizes. The tabular grains have {111} major faces, contain greater than 80 mole percent bromide, based on silver, and either contain iodide or are substantially free of iodide, exhibit an average aspect ratio of greater than 50 and an average equivalent circular diameter of >10 micrometers, account for greater than 90 percent of total grain projected area, and have latent image forming chemical sensitization sites on their surfaces including epitaxially deposited silver halide protrusions of a face centered cubic rock salt crystal lattice structure forming epitaxial junctions with the tabular grains. The protrusions are restricted to those portions of the tabular grains (a) located nearest peripheral edges of and (b) account for less than 50 percent of the {111} major faces of the tabular grains. The protrusions contain (c) a silver iodide concentration higher than that of the tabular grains and (d) a silver chloride concentration at least 10 mole percent higher than that of the tabular grains.

SUMMARY OF THE INVENTION

In one aspect this invention is directed to a radiation-sensitive emulsion comprised of (1) a dispersing medium, (2) silver halide grains including tabular grains (a) having {111} major faces, (b) containing greater than 70 mole percent bromide and up to 10 mole percent iodide, based on silver, (c) accounting for greater than 90 percent of total grain projected area, and (d) having latent image forming chemical sensitization sites on the surfaces of the tabular grains, and (3) a spectral sensitizing dye adsorbed to the surface of the tabular grains, wherein (4) the surface chemical sensitization sites include epitaxially deposited silver halide protrusions of a face centered cubic rock salt crystal lattice structure forming epitaxial junctions with the tabular grains, the protrusions (a) being restricted to those portions of the tabular grains located nearest peripheral edges of and accounting for less than 10 percent of the {111} major faces of the tabular grains, (b) accounting for less than 5 percent of total silver forming the tabular grains and protrusions, (c) containing a silver chloride concentration at least 10 mole percent higher than that of the tabular grains, and (d) containing at least 1 mole percent iodide, based on silver in the protrusions, and (5) the tabular grains exhibit an average equivalent circular diameter of at least 3.5 μm.

It has been discovered quite surprisingly that, by the selection of the composition and the amount of silver halide epitaxy, a large (≧3.5 μm mean ECD) tabular grain emulsion exhibiting improved photographic properties can be realized when speed, granularity and contrast are considered. Specifically, selecting a mixed halide composition of the epitaxy as noted above increases photographic speeds while limiting the amount of the epitaxy to less than 5 mole percent, based on total silver, in large tabular grain emulsions further results in marked increases in contrast and improvements in speed-granularity relationships, typically observed as both speed increases and granularity reductions. In more commonly encountered, smaller mean ECD tabular grain emulsions limiting epitaxy reduces speed and lowers contrast.

DESCRIPTION OF PREFERRED EMBODIMENTS

The invention is directed to an improvement in spectrally sensitized photographic emulsions. The invention provides for use in black-and-white (including indirect X-ray) and color photography emulsions relatively high speeds, granularity that is low in relation to speed, and increased contrasts.

The advantages of the invention are realized by the chemical and spectral sensitization of tabular grain emulsions in which the host tabular grains (a) have {111} major faces, (b) contain greater than 70 mole percent bromide and up to 10 mole percent iodide, based on silver forming the host tabular grains, (c) account for greater than 90 percent of total grain projected area, and (e) exhibit an average equivalent circular diameter of at least 3.5 micrometers.

Host tabular grain emulsions satisfying criteria (a)–(e) can be selected from among conventional {111} tabular grain emulsions. The following, here incorporated by reference, illustrate preferred emulsion preparations:

Saitou et al U.S. Pat. No. 4,797,354,

Daubendiek et al U.S. Pat. No. 4,914,014,

Piggin et al U.S. Pat. No. 5,061,609,

Piggin et al U.S. Pat. No. 5,061,616,

Tsaur et al U.S. Pat. No. 5,210,013,

Antoniades et al U.S. Pat. No. 5,250,403,

Delton U.S. Pat. No. 5,372,927,

Maskasky U.S. Pat. No. 5,411,851,

Maskasky U.S. Pat. No. 5,418,125,

Wen U.S. Pat. No. 5,470,698,

Delton U.S. Pat. No. 5,460,934,

Olm et al U.S. Serial No. 08/296,562, filed Aug. 26, 1994, now allowed,

Daubendiek et al U.S. Ser. No. 08/297,430, filed Aug. 26, 1994, now allowed, and Daubendiek et al U.S. Ser. No. 08/359,251, filed Dec. 19, 1994, now allowed.

Zola et al EPO 0 362 699 A3 also discloses silver iodobromide tabular grain emulsions that are useful host tabular grain emulsions for the practice of the invention.

The host tabular grain emulsions can contain up to 10 mole percent iodide, based on total silver forming the tabular grains. Iodide has traditionally been relied upon to enhance photographic speed and, in color photography, to enhance interimage effects. In this application iodide in the host tabular grains is not required to achieve maximum attainable levels of sensitivity. Iodide incorporation can be employed to stabilize the morphology of the tabular grains. In other words, iodide stabilizes the emulsions against unwanted grain thickening during ripening following precipitation. The host tabular grains preferably contain less than 10 mole percent iodide, preferably less than 6 mole percent iodide, and optimally less than 4 mole percent iodide, based on total silver forming the host tabular grains. Iodide can be either uniformly or nonuniformly distributed in the host tabular grains, but to maximize stabilization of the morphology of the host tabular grains, uniform iodide distribution is preferred.

Surprisingly, when the mean ECD of the host tabular grains exceeds 10 μm, the highest observed photographic speeds in the completed emulsions have been observed when iodide is absent from the host tabular grains. In the preferred precipitations incorporated by reference above silver iodide containing host tabular grain emulsion precipitations can be converted to precipitations of grains that are substantially free of iodide merely by omitting iodide from the precipitation procedure. This is well known in the art, as illustrated by the teachings of Kofron et al.

It is possible to include minor amounts of chloride ion in the host tabular grains. As disclosed by Delton U.S. Pat. Nos. 5,372,927 and 5,460,934, here incorporated by reference, tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (°C.) boundaries of Curve A (preferably within the boundaries of Curve B) shown by Delton. Under these conditions of precipitation the presence of chloride ion actually contributes to reducing the thickness of the tabular grains.

As fully grown the host tabular grains contain at least 70 mole percent bromide with chloride and up to 10 mole percent iodide, based on silver, being optionally present. Thus the host tabular grain emulsion include silver bromide, silver chlorobromide, silver iodobromide, silver chloroiodobromide and silver iodochlorobromide tabular grain emulsions.

Although the majority of published tabular grain precipitation Examples produce tabular grain mean ECD's of less than 3.0, these procedures can be modified to produce tabular grain mean ECD's of 3.5 μm and larger merely by extending the growth step by the further addition of silver and halide ions. The extended addition of silver and halide ions can be used to produce emulsions having mean ECD's up to 5 μm, the art recognized (e.g., refer to Goda U.S. Pat. No. 4,775,617, Bando U.S. Pat. No. 4,839,268, Momoki U.S. Pat. No. 4,914,010, and Saitou et al U.S. Pat. No. 4,977,074) maximum efficient tabular grain mean ECD.

It has been discovered quite surprisingly that further increases in photographic speed can be realized in the completed emulsions when host tabular grain mean ECD's are increased beyond 5 μm to the currently accepted (e.g., refer to Ikeda et al U.S. Pat. No. 4,806,461, Bell et al U.S. Pat. No. 5,132,203, Tsaur et al U.S. Pat. No. 5,210,013, Antoniades et al U.S. Pat. No. 5,250,403, Kim et al U.S. Pat. No. 5,272,048, Sutton et al 5,334,469, Black et al U.S. Pat. No. 5,334,495, Maskasky U.S. Pat. Nos. 5411,851 and 5,418,125, Delton U.S. Pat. No. 5,460,934, and Wen U.S. Pat. No. 5,470,698) upper useful mean ECD of 10 μm.

As taught by Eshelman et al, cited above, and demonstrated in the Examples below useful mean ECD's can quite surprisingly range well above 10 μm. For example, host tabular grain emulsions with mean ECD's of up to 15 μm are within the contemplation of preferred embodiments of the invention.

The host tabular grains accounting for greater than 90 percent of total grain projected area preferably exhibit mean thicknesses ($t_m$) of less than 0.3 μm. Thin ($t_m$<0.2 μm) tabular grain emulsions are specifically preferred, and ultrathin ($t_m$<0.07 μm) tabular grain emulsions are contemplated, although it is recognized that tabular grain thicknesses tend to increase as mean ECD's increase toward maximum contemplated ECD's.

The host tabular grain emulsions preferably exhibit average aspect ratios of at least 5 and most preferably greater than 8. By limiting the mean thicknesses of the tabular grains, average aspect ratios of 50 to 100 or more can realized. For example, tabular grain emulsions exhibiting average aspect ratios of 100 are exhibited by (a) 5 μm ECD, $t_m$ 0.05 μm and (b) 10 μm ECD, $t_m$ 0.10 μm tabular grain emulsions, each of which are well within tabular grain precipitation capabilities.

The chemical and spectral sensitizations of this invention improve upon the best chemical and spectral sensitizations disclosed by Maskasky I. In the practice of the present invention host tabular grains receive during chemical sensitization epitaxially deposited silver halide forming protrusions at selected sites on the host tabular grain surfaces. Maskasky I observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host tabular grains. It would be more precise to reference the higher chloride concentration in the silver halide protrusions to the chloride ion concentration in the epitaxial junction forming portions of the host tabular grains, but this is not necessary, since the chloride ion concentrations of the host tabular grains are contemplated to be substantially uniform (i.e., to be at an average level) or to decline slightly due to iodide displacement in the epitaxial junction regions.

Contrary to the teachings of Maskasky I, it has been found that improvements in photographic speed and contrast can be realized by adding iodide ions along with silver and chloride ions to the ultrathin tabular grain emulsions while performing epitaxial deposition. This results in increasing the concentration of iodide in the epitaxial protrusions above the low (substantially less than 1 mole percent) levels of iodide that migrate from iodide containing host tabular grains during silver and chloride ion addition. Although any increase in the iodide concentration of the face centered cubic crystal lattice structure of the epitaxial protrusions improves photographic performance, it is preferred to increase the iodide concentration to a level of at least 1.0 mole percent, preferably at least 1.5 mole percent, based on the silver in the silver halide protrusions.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos.

5,238,804 and 5,288,603 (hereinafter referred to as Maskasky II and III, respectively). Precipitation at ambient pressure, which is universally practiced in the art, limits iodide inclusion in a silver chloride crystal lattice to less than 13 mole percent. For example, introducing silver along with an 84:16 chloride:iodide molar ratio during silver halide epitaxial deposition resulted in an iodide concentration in the resulting epitaxial protrusions of less than 2 mole percent, based on silver in the protrusions. By displacing a portion of the chloride with bromide much higher levels of iodide can be introduced into the protrusions. For example, introducing silver along with a 42:42:16 chloride:bromide:iodide molar ratio during silver halide epitaxial deposited resulted in an iodide concentration in the resulting epitaxial protrusions of 7.1 mole percent, based on silver in the protrusions. Preferred iodide ion concentrations in the protrusions are in the range of from 1 to 15 mole percent (most preferably 2 to 10 mole percent), based on silver in the protrusions.

It has been discovered quite unexpectedly that further increases in speed and improvements in speed-granularity relationships at mean ECD's ≧3.5 μm can be realized by introducing along with silver ions during epitaxial deposition chloride, bromide and iodide ions. Since silver bromide and iodobromide epitaxy on silver iodobromide host tabular grains produces lower levels of sensitization than concurrent introductions of silver, chloride and iodide ions during epitaxy, it was unexpected that displacement of a portion of the chloride with bromide would further increase photographic performance. Analysis indicates that the introduction of chloride and bromide ions during precipitation of the epitaxial protrusions facilitates higher iodide incorporations. This can be explained in terms of the increased crystal cell lattice dimensions imparted by the increased levels of bromide ions. It does not explain why photographic performance increased rather than declining to more closely approximate that imparted by silver iodobromide epitaxial protrusions.

It is believed that the highest levels of photographic performance are realized when the silver halide epitaxy contains both (1) the large differences in chloride concentrations between the host tabular grains and the epitaxially deposited protrusions noted above and (2) elevated levels of iodide inclusion in the face centered cubic crystal lattice structure of the protrusions.

One preferred technique relevant to objective (1) is to introduce the different halide ions during precipitation of the protrusions in the order of descending solubilities of the silver halides that they form. For example, if chloride, bromide and iodide ions are all introduced during precipitation of the protrusions, it is preferred to introduce the chloride ions first, the bromide ions second and the iodide ions last. Because silver iodide is less soluble than silver bromide which is in turn less soluble than silver chloride, the sequential order of halide ion addition preferred gives the chloride ion the best possible opportunity for deposition adjacent the junction. A clear stratification of the protrusions into regions exhibiting higher and lower chloride ion concentrations can in some instances be detected, but may not be detectable in every instance in which the preferred sequential halide addition is employed, since both bromide and iodide ions have the capability of displacing chloride to some extent from already precipitated silver chloride.

Increasing iodide levels in the protrusions runs directly contrary to a prior belief in the art that iodide in epitaxially deposited protrusions should be minimized to avoid morphological instability in the host tabular grains. However, it has been observed that increased iodide concentrations in the epitaxially deposited protrusions as described above is not incompatible with maintaining the tabular configuration of the host grains, even in emulsions having mean tabular grain thicknesses of <0.07 μm.

In the practice of the invention the elevated iodide concentrations in the protrusions are those that can be accommodated in a face centered rock salt cubic crystal lattice structure—that is, the type of isomorphic crystal lattice structure formed by silver and one or both of chloride and bromide. It is, of course, possible to incorporate limited amounts (generally cited as 10 mole percent or less) of bromide and/or chloride ions into nonisomorphic β or γ phase silver iodide crystal structures; however, nonisomorphic silver halide epitaxy forms no part of this invention. The structures are too divergent to ascribe similar photographic properties, and nonisomorphic epitaxial protrusions have been demonstrated by Maskasky U.S. Pat. No. 4,471,050 (hereinafter Maskasky IV) to produce much lower levels of sensitization than isomorphic crystal structure silver halide epitaxial protrusions.

Either or both of the tabular grains and silver halide epitaxy can contain conventional dopants. A summary of conventional dopants is provided by *Research Disclosure,* Vol. 365, September 1994, Item 36544, I. Emulsion grains and their preparation, D. Grain modifying conditions and adjustments, (3), (4) and (5). The incorporation of shallow electron trapping (SET) dopants in the substrate tabular grains and/or the silver halide epitaxy, as disclosed by *Research Disclosure,* Vol. 367, Nov. 1994, Item 36736, is specifically contemplated. The teachings of Olm et al U.S. Ser. No. 08/296,562, here incorporated by reference, disclose preferred SET dopants in the epitaxy.

Subject to the composition modifications specifically described above, preferred techniques for chemical and spectral sensitization are those described by Maskasky I, cited above and here incorporated by reference. Maskasky I reports improvements in sensitization by epitaxially depositing silver halide at selected sites on the surfaces of the host tabular grains. Maskasky I attributes the speed increases observed to restricting silver halide epitaxy deposition to a small fraction of the host tabular grain surface area.

It has been discovered quite unexpectedly that large (≧3.5 μm mean ECD) tabular grain emulsions containing the epitaxial protrusions described above exhibit increased contrast, lower granularity, equal or increased speed, and improved speed-granularity relationships when the coverage and amount of the silver halide epitaxy is limited. Specifically, to achieve these performance advantages, the epitaxial protrusions must account for less than 5 percent of the total silver forming the protrusions and tabular grains (i.e., the composite grains) and occupy less than 10 percent of the {111} major faces of the tabular grains. A preferred minimum level of epitaxy is about 0.5 percent of the total silver of the composite grains, with 1.0 percent being a specifically preferred minimum. As the mean ECD of the tabular grains increases, lower levels of epitaxy are required. For tabular grain emulsions having mean ECD's of >5 μm or more, a preferred maximum percentage of the total silver of the composite grains in the protrusions less than 4 percent.

Since the amount of total silver provided by the protrusions is quite limited, restriction of the protrusions to a small percentage of the {111} major faces is readily achieved by selective site deposition techniques taught by Maskasky I. It is preferred to limit the epitaxy to less than 5 percent of the {111} major faces. The epitaxy is preferably directed to the edges and, most preferably, the corners of the host tabular grains. A large portion of the epitaxy can project from rather than overlie the {111} major faces, allowing the epitaxy to overlie very limited regions of the {111} major faces, as low as 1 percent or even less.

For reasons that are not understood, limiting the percentage of total silver provided by the epitaxy increases contrast and either increases or leaves unaffected the speed of tabular grain emulsions exhibiting ≧3.5 μm mean ECD, but in otherwise comparable conventional, smaller mean ECD tabular grain emulsions both contrast and speed are reduced by similarly limiting the epitaxy. The invention then improves the performance of large tabular grain emulsions in a manner that was entirely unexpected.

Maskasky I teaches various techniques for restricting the surface area coverage of the host tabular grains by silver halide epitaxy that can be applied in forming the emulsions of this invention. Maskasky I teaches employing spectral sensitizing dyes that are in their aggregated form of adsorption to the tabular grain surfaces capable of direct silver halide epitaxy to the edges or corners of the tabular grains. Cyanine dyes that are adsorbed to host tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the host tabular grains is more efficient than that overlying all or most of the major faces, still better is epitaxy that is substantially confined to the edges of the host tabular grains, with limited coverage of their major faces, and still more efficient is epitaxy that is confined at or near the corners or other discrete sites of the tabular grains. The spacing of the corners of the major faces of the host tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain.

While silver halide epitaxy can by itself increase photographic speeds, additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure,* vol. 365, Sept. 1994, Item 36544, Section IV. Chemical sensitization. Kofron et al illustrates the application of these sensitizations to tabular grain emulsions. Maskasky I, Olm et al U.S. Ser. No. 08/296,562, and Daubendiek et al U.S. Ser. Nos. 08/297,430 and 08/359,251, here incorporated by reference, illustrate the application of these sensitizations to tabular grain emulsions containing silver halide epitaxy on the tabular grains.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

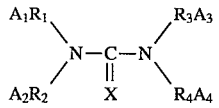

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^-$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. Maskasky I teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the host tabular grain emulsions of the invention. The selection of J-aggregating blue absorbing spectral sensitizing dyes for use as site directors is specifically contemplated. A general summary of useful spectral sensitizing dyes is provided by *Research Disclosure,* Item 36544, Section V. Spectral sensitization and desensitization, A. Sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an host tabular grain according to the invention after chemical sensitization has been completed.

The tabular grain emulsions with silver halide epitaxy once formed and sensitized can be further prepared for photographic use by any convenient conventional technique. Additional conventional features are illustrated by *Research Disclosure* Item 36544, cited above, Section II. Vehicles, vehicle extenders, vehicle-like addenda and vehicle related addenda; Section III. Emulsion washing; Section VI, UV dyes/optical brighteners/luminescent dyes; Section VII. Antifoggants and stabilizers; Section VIII. Absorbing and scattering materials; Section IX. Coating physical property modifying addenda; and Section X. Dye image formers and modifiers.

Any one of the emulsions of the invention can be coated alone onto a conventional photographic support, such as disclosed in *Research Disclosure,* Item 36544, cited above, Section XV. Supports, to form a photographic element. The emulsions of the invention can be blended with other conventional emulsions and/or coated on a photographic support along with other conventional emulsion layers. Such arrangements are illustrated by *Research Disclosure,* Item 36544, cited above, Section I. Emulsion grains and their precipitation, E. Blends, layers and performance categories. A plurality of layers containing one or more emulsions according to the invention can be incorporated into a single photographic element. Illustrations of photographic elements containing multiple emulsion layers compatible with incorporation of one or more emulsions according to the invention are found in *Research Disclosure,* Item 36544, cited above, Section XI. Layers and layer arrangements; XII. Features applicable to only color negative; XIII. Features applicable only to color reversal; and XIV. Scan facilitating features.

Photographic elements containing one or more emulsions according to the invention can be exposed by any convenient conventional technique, such as illustrated by *Research Disclosure,* Item 36544, cited above, Section XVI. Exposure. The exposed photographic elements can be conventionally processed, as illustrated by *Research Disclosure,* Item 36544, cited above, Section XVIII. Chemical development systems; Section XIX. Development; and XX. Desilvering, washing, rinsing and stabilizing.

EXAMPLES

The invention can be better appreciated by reference to the following specific embodiments. M % is used to indicate mole percent.

Epitaxial Sensitizations

Various tabular grain emulsions, described in the Examples below, were epitaxially sensitized by the following general procedure:

A sample of the emulsion was melted at 40° C. and its pBr was adjusted to ~4 with simultaneous addition of $AgNO_3$ and KI solutions in a ratio such that the small amount of silver halide precipitated during this adjustment was 12% I. On a basis of one mole of host emulsion, a solution containing 5 mmol KI and 19.97 mmol NaCl were added, followed by addition of the spectral sensitizing dyes DYE-1 and DYE-2. A solution containing 25.2 mmol NaCl, 25.2 mmol NaBr, 10.1 μmol $K_4Ru(CN)_6$, and 9.6 mmol of an AgI Lippmann emulsion is added. Epitaxial deposition (42:42:16 Ci:Br:I molar ratio added) in the amount of 6M %, based on total silver, was completed by a 1 minute addition of 50.4 mmol 0.5M $AgNO_3$ solution. Variations in the amount of epitaxy, noted in the Examples below, were accomplished by scaling all halide and silver additions proportionally. This procedure produced epitaxial protrusions mainly on the corners of the host tabular grains. From scanning electron micrographs of the composite grains, it was apparent that the epitaxy occupied much less than 5 percent of the {111} major faces.

The epitaxially modified emulsion was split into smaller portions in order to determine optimal levels of subsequently added sensitizing components. The post-epitaxy components included additional portions of DYE-1 and DYE-2, NaSCN, 1,3-dicarboxymethyl-1,3-dimethyl-2-thiourea disodium salt monohydrate (DCT), Bis(1,4,5-Trimethyl-1,2,4-Triazolium-3-Thiolate) Gold(I) Tetrafluoroborate (Au-I), and 11.4 mg 1-(3-acetamidophenyl)-5-mercaptotetrazole (APMT)/mole Ag. After all components were added, the mixture was heated to 50° C. to complete the sensitization, and, after cool-down, additional APMT was added.

DYE-1

Anhydro-5-chloro-9-ethyl-5'-phenyl-3'-(3-sulfobutyl)-3-(3-sulfopropyl)oxacarbocyanine hydroxide, sodium salt

DYE-2

Anhydro-6,6'-dichloro-1,1'-diethyl-3,3'-bis-(3-sulfopropyl)-5,5'-bis(trifluoromethyl)benzimidazole carbocyanine hydroxide, sodium salt Sensitometry The resulting sensitized emulsions were coated on a cellulose acetate photographic film support with a Rem Jet™ back side anithalation layer. The coatings contained 0.8 g Ag/m$^2$, 1.6 g/m$^2$ COUP-1 and 3.2 g/m$^2$ gelatin. The antifoggant 4-hydroxy-6-methyl-1,3,3a,7-tetraazaindene was coated in the emulsion layer in the amount of 2 g per Ag mole. The emulsion layer was overcoated with a 3.2 g/m$^2$ gelatin layer containing the hardening agent bis(vinylsulfonylmethyl)ether at a concentration of 1.8 wt. %, based on the total weight of gelatin.

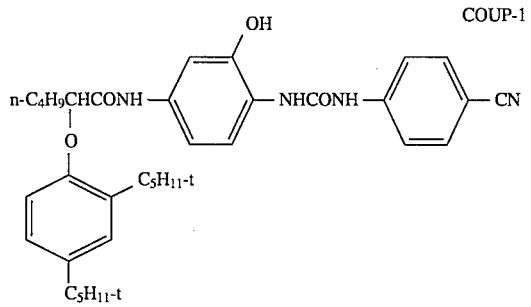

The coated emulsions were given a 0.01 second exposure by a 5500° K. halogen lamp through a Wratten 9™ filter and 21 step calibrated neutral step tablet, and then developed for 3 minutes, 15 seconds using the color negative Kodak Flexicolor C41™ process.

The optical density (D) of the resulting dye scales were plotted as a function of log E (where E represents exposure in lux-seconds). Speed was measured at an optical density of 0.15 above the minimum density. In comparing speeds, 30 relative log speed units equal a speed difference of 0.3 log E. An emulsion having a relative log speed 30 units higher than that of another emulsion, exhibits twice the photographic sensitivity of the other emulsion. Contrast was taken as the highest measured point gamma (dD/dlog E), see James *The Theory of the Photographic Process,* 4th Ed., Macmillan, New York, 1977, p. 502. Granularity measurements were made according to the procedures described in the *SPSE Handbook of Photographic Science and Engineering,* W. Thomas, Ed., pp. 934–939. A comparison of the granularity difference between two coatings is reported in grain units (ΔGU). The granularity readings at each step were divided by the gamma at each step and plotted vs log E. In such plots, there is typically a minimum. The minimum of this gamma-normalized granularity provides what is generally regarded as a preferred comparison of coatings having differing contrast. Lower values of the minimum gamma-normalized granularity are desired, providing less grainy images. The relative log speed, relative granularity and contrast for each coating are summarized below.

Example 1 (Control)

This example demonstrates that speed and contrast decline when the epitaxial sensitization levels of a 1.5 μm mean ECD tabular grain emulsion are reduced from 6 to 2 percent of total silver forming the composite grains.

A reaction vessel equipped with a stirrer was charged with 8.97 L of water containing 26.9 grams of lime-processed, oxidized bone gelatin, 7.13 g NaBr, 4.485 g of ammonium sulfate and an antifoamant, at pH of 2.5 and 35° C. During nucleation by simultaneous 0.2 min. addition of 2M $AgNO_3$ and halide solution (1.96M NaBr, 0.04M KI) added in sufficient quantity to form 0.04 mol of silver bromide, pBr and pH remained approximately at the values initially set in the reactor solution. After nucleation and 15 minute ammonia ripening, 100 g of lime-processed, oxidized bone gelatin dissolved in 1.5 L of $H_2O$ were added to the reactor. Twenty-five minutes after nucleation the temperature was increased in 6 minutes to 45° C. and pBr was adjusted with 44 mL of 4M NaBr. The growth stage was begun during which 3.8M $AgNO_3$, 4M NaBr solution, and a suspension of 0.24M AgI (Lippmann) was added in proportions to maintain a uniform iodide level of 3.0M % in the growing silver halide crystals and the reaction vessel pBr at the value resulting from the cited halide and $AgNO_3$ additions. This pBr was maintained until 8.32 moles of silver iodobromide had formed. At this point, no additional AgI suspension was added to the reaction vessel, but growth continued at the same rate with 3.8M $AgNO_3$ and 4M NaBr solutions to supply 0.45 mole of additional silver. The resulting emulsion was washed by ultrafiltration, and pH and pBr were adjusted to storage values of 5.9 and 2.5, respectively.

Tabular grains accounted for greater than 95 percent of the total grain projected area. The mean ECD of the grains of this emulsion was 1.6 μm, and the mean tabular grain thickness was 0.05 μm.

Using the sensitizations and sensitometry described above the performance of samples of the emulsion receiving 6, 4.24 and 2M % epitaxy, based on total silver. The photographic performance is summarized in Table I.

TABLE I

| Epitaxy (% ΣAg) | Relative Log Speed | Granularity (Δ GU) | Contrast |
|---|---|---|---|
| 6 | 100 | Ref. | 2.32 |
| 4.24 | 101 | 0 | 2.29 |
| 2 | 94 | −0.5 | 2.15 |

The 1.5 μm mean ECD tabular grain emulsion lost speed and contrast as the level of epitaxy was reduced from 6 to 2M % of total silver. The small improvement in granularity at the lowest level of epitaxy was insufficient to compensate for the speed loss; the speed-granularity relationship also became worse as the level of epitaxy was decreased. It is generally accepted that a speed difference of 0.3 log E (30 relative speed units) is equivalent to a granularity of difference of 7 grain units in emulsions of equal imaging efficiency. Applying this standard the 2M % epitaxy sample should have shown a loss of −1.6 grain units to compensate for the observed speed loss or, a relative log speed of 99 at the measured granularity. In other words, the speed-granularity of the 2M % epitaxy sample was inferior.

Example 2

This example is similar to Example 1, but substitutes a host tabular grain emulsion having a mean ECD of 3.5 μm, satisfying the requirements of the invention, for the smaller tabular grain emulsion. Performance with and without the $[Ru(CN)_6]^{-4}$ SET dopant in the epitaxy is reported.

A reaction vessel equipped with a stirrer was charged with 6.75 L of water containing 10 grams of lime-processed, oxidized bone gelatin, 5 g NaBr, 13.6 g of ammonium sulfate and an antifoamant, at pH of 2.5 and 35° C. During nucleation by simultaneous 0.1 min. addition of 1.9M $AgNO_3$ and halide solution (2.46M NaBr, 0.0375M KI) added in sufficient quantity to form 0.012 mol of silver bromide, pBr and pH remained approximately at the values initially set in the reactor solution. After nucleation and 15 minute ammonia ripening, 100 g of lime-processed, oxidized bone gelatin dissolved in 1.5 L of $H_2O$ were added to the reaction vessel and pH was adjusted to 5.6. Twenty-five minutes after nucleation the temperature was increased in 6 minutes to 45° C. and pBr was adjusted with 100 mL of 4M NaBr. The growth stage was begun during which 3.8M $AgNO_3$, 4M NaBr solution, and a suspension of 0.062M AgI (Lippmann) were added in proportions to maintain a uniform iodide level of 3.0M % in the grains being grown and the reaction vessel pBr at the value resulting from the cited halide and $AgNO_3$ additions. This pBr was maintained until 8.65 moles of silver iodobromide were precipitated. At this point, no additional AgI suspension was added to the reaction vessel, but growth continued at the same rate with 3.8M $AgNO_3$ and 4M NaBr solutions to form a 0.45 mole AgBr shell. The resulting emulsion was washed by ultrafiltration, and pH and pBr were adjusted to storage values of 5.9 and 2.5, respectively.

Tabular grains accounted for greater than 95 percent of the total grain projected area. The mean ECD of the grains of this emulsion was 3.5 μm, and the mean tabular grain thickness was 0.08 μm.

Using the sensitizations and sensitometry described above the performance of samples of the emulsion receiving 6 and 4.24M % epitaxy, based on total silver, with and without $[Ru(CN)_6]^{-4}$ dopant were compared. The photographic performance is summarized in Table II.

TABLE II

| Epitaxy (% ΣAg) | Dopant | Relative Log Speed | Granularity (Δ GU) | Contrast |
|---|---|---|---|---|
| 6 | No | 100 | Ref. | 1.44 |
| 4.24 | No | 116 | +0.5 | 1.51 |
| 6 | Yes | 117 | −0.3 | 1.61 |
| 4.24 | Yes | 132 | −2.5 | 1.62 |

From Table II it is apparent that the 3.5 μm mean ECD tabular grain emulsion, unlike the smaller mean ECD emulsion of Example 1 (Table I), exhibited an increase in contrast when the level of epitaxy was lowered below 5 mole percent, based on total silver forming the composite grains. Further granularity decreased or increased only slightly in comparison to the speed gain observed. That is, the speed-granularity relationship was also improved.

Examples 3 to 5

These Examples compare the performance of three tabular grain emulsions each having mean ECD's of approximately 4–5 μm, but mean thicknesses ($t_m$) of 0.04, 0.08 and 0.11 μm, respectively. Although emulsions of each mean grain thickness are shown to demonstrate the advantages of the invention, by comparison it is apparent that performance improved progressively as $t_m$ was reduced, with the ultrathin ($t_m$ <0.07 μm) emulsions exhibiting superior levels of performance. The relative log speeds in Tables III, IV and V are all referenced to the 9.5M % epitaxy emulsion in Table III, which is assigned a relative log speed of 100.

Example 3

Silver bromide grain nuclei were generated in a continuous double jet stirred reaction vessel at a pBr of 2.3, a temperature of 40° C., a nuclei suspension density of 0.033 mole of silver bromide per liter, an average residence time of 1.5 seconds and an average oxidized gelatin concentration of 2 g/L. The grain nuclei generation was carried out by mixing at steady state in the continuous reaction vessel a solution of oxidized gelatin (2.4 g/L) at 1 liter per minute with a sodium bromide solution (0.47M) at 0.1 L per minute and a silver nitrate solution (0.4M) at 0.1 L per minute. The output of the continuous precipitation were allowed to come to steady state before being used in the subsequent precipitation steps.

The silver bromide nuclei were transferred to a semi-batch reaction vessel over a period of 30 seconds. Initially the semi-batch reaction vessel was at a pBr of 3.2, a temperature of 70° C., and a pH of 4.5. The semi-batch reaction vessel initially contained oxidized gelatin at a concentration of 1.7 g/L and a total volume of 16 liters that was subsequently maintained at this level by ultrafiltration. When the transfer of grain nuclei was completed, the pBr of the semi-batch reaction vessel was changed to 1.6 by rapidly adding a sodium bromide solution and held for 4 minutes.

During subsequent growth all reactants were added through the continuous reaction vessel used for nuclei formation. The reactants added and mixed in the continuous reaction vessel were a solution of oxidized gelatin (pH 4.5, 4.8 g/L, 0.5 L/min), a silver nitrate solution (0.67M), and a mixed salt solution of sodium bromide and potassium iodide (0.67M, 2.8M % iodide). The silver nitrate solution flow rate was ramped from 0.02 L/min to 0.08 L/min over a period of 30 minutes and from 0.08 L/min to 0.13 L/min over 30 minutes, and finally from 0.13 to 0.16 L/min over a period of 30 minutes. The pBr of the continuous reaction vessel during this growth step was maintained by controlling the mixed salts solution flow rate. The contents of the continuous reaction vessel were maintained at 30° C. The pBr of the semi-batch reaction vessel during growth was controlled at a pBr of 1.9 by the direct addition of a sodium bromide solution to this reaction vessel as required, and the temperature of the contents of the semi-batch reaction vessel was maintained at 70° C.

Tabular grains accounted for greater than 95 percent of the total grain projected area. The mean ECD of the grains of this emulsion was 3.9 μm, and the mean tabular grain thickness was 0.04 μm.

Using the sensitizations and sensitometry described above the performance of samples of the emulsion receiving 9.5, 6 and 4.24M % epitaxy, based on total silver, were compared. The photographic performance is summarized in Table III.

TABLE III

| Epitaxy (% ΣAg) | Relative Log Speed | Granularity (Δ GU) | Contrast |
|---|---|---|---|
| 9.5 | 100 | Ref. | 1.15 |
| 6 | 106 | −4.0 | 1.63 |
| 4.24 | 127 | −7.0 | 1.88 |

As the level of epitaxy declined, contrast increased and granularity decreased. However, no increase in photographic speed was observed until the epitaxy was lowered below 5M % of total silver.

Example 4

A reaction vessel equipped with a stirrer was charged with a solution made from 45.4 Kg water, 184 g oxidized, lime-processed bone gelatin, 322 g NaBr, and an antifoamant. The pH at 40° C. was 5.7. The temperature was raised to 55° C. Then 3.45 L of 0.098M $AgNO_3$ solution were added over 6 sec. The flow of the $AgNO_3$ solution was continued at a rate of 0.1725 L/min for a period of 7.5 min. During this same time period, the temperature was ramped to 70° C. After reaching 70° C., 2 L of a 0.2128M ammonium hydroxide solution was added. The flow of the $AgNO_3$ solution continued at the rate of 0.1725 L/min for 5 min. Then the flow of $AgNO_3$ was suspended and 2 L of a 0.1625M $HNO_3$ solution was added. A solution of 23.96 Kg water, 1.15 Kg oxidized lime-processed bone gelatin, and an antifoamant was also added. Next, a solution of 1.4M $AgNO_3$, a 0.1884M AgI (Lippmann) suspension, and a 1.4M NaBr solution were added in proportions such that the molar iodide concentration was maintained at 3M % in the silver iodobromide emulsion being precipitated and such that the pBr was maintained at the value it was immediately prior to the addition of these solutions and suspension. This pBr was maintained and the flow of these solutions and suspension was maintained until a total of 74.6 mole of silver iodobromide emulsion was precipitated. The flow of the AgI suspension was halted, but the flows of the $AgNO_3$ and NaBr solutions were continued until a total of 78.6 mole of silver iodobromide emulsion was precipitated. The emulsion was washed by ultrafiltration. Additional gelatin was added for storage and the pH and pBr were adjusted to 5.8 and 2.5, respectively.

Tabular grains accounted for greater than 95 percent of the total grain projected area. The mean ECD of the grains of this emulsion was 5.1 μm, and the mean tabular grain thickness was 0.08 μm.

Using the sensitizations and sensitometry described above, except as noted, the performance of samples of the emulsion receiving 6, 4, 3 and 2M % epitaxy, based on total silver, were compared. The 6M % epitaxy contained 300 molar parts per million (mppm) $[Ru(CN)_6]^{-4}$ while twice that amount was present in the epitaxy of the other emulsions. The sulfur and gold sensitizers, NaSCN and APMT were each varied, with the levels providing optimum results being reported. Development was conducted for 3 minutes 15 seconds. The photographic performance is summarized in Table IV.

TABLE IV

| Epitaxy (% ΣAg) | Dmin | Relative Log Speed | Granularity (Δ GU) | Contrast |
|---|---|---|---|---|
| 6 | 0.11 | 112 | Ref. | 0.72 |
| 4 | 0.08 | 131 | −1.6 | 0.86 |
| 3 | 0.11 | 124 | −0.9 | 1.06 |
| 2 | 0.12 | 123 | −2.3 | 1.19 |

As the level of epitaxy declined, contrast increased and granularity decreased. The highest level of speed was observed 4M % epitaxy. When gamma normalized granularity was observed, the 6M % epitaxy sample exhibited the highest granularity while the 2M % epitaxy exhibited a −2.3 grain unit drop in granularity.

Example 5

A reaction vessel equipped with a stirrer was charged with a solution made from 62 L water, 375 g NaBr, 125 g lime-processed bone gelatin, and an antifoamant. The pH was adjusted to a value of 6 at 40° C. The temperature was then raised to 75° C. Simultaneously 0.62 L of a 0.50M $AgNO_3$ solution and 0.229 L of a 2.0M NaBr solution were added over a period of 1 min. The AgBr thus formed were ripened for 1.5 min after addition of 0.6 L of 0.5M ammonium sulfate and 0.7 L of 1M NaOH. An 18.8 L solution containing 1.763 Kg lime-processed bone gelatin, 125 g NaBr, and an antifoamant was added to the reaction vessel, and the pH was adjusted to a value of 6. A solution that was 2.75M $AgNO_3$ and a solution that was 2.67M NaBr and 0.0825M KI were added simultaneously in proportions to maintain the pBr at the value it was immediately prior to this step. The flows of these solutions were continued until a total of 106.0 moles of silver iodobromide had been precipitated. The flow of the halide solution was then discontinued while the $AgNO_3$ flow was continued until a total of 111.6 moles of silver iodobromide was precipitated. The emulsion was then washed by ultrafiltration. Additional gel was added for storage, the pH was adjusted to 6.0, and the pBr was adjusted to 2.5.

Tabular grains accounted for greater than 95 percent of the total grain projected area. The mean ECD of the grains of this emulsion was 3.85 μm, and the mean tabular grain thickness was 0.11 μm.

Sensitization and sensitometry were as described in Example 4. The performance is summarized in Table V.

TABLE V

| Epitaxy (% ΣAg) | Dmin | Relative Log Speed | Granularity (Δ GU) | Contrast |
|---|---|---|---|---|
| 6 | 0.08 | 114 | Ref. | 0.51 |
| 4 | 0.08 | 118 | −0.1 | 0.53 |
| 3 | 0.09 | 107 | −2.4 | 0.64 |
| 2 | 0.10 | 99 | −0.3 | 0.71 |

As the level of epitaxy declined, contrast increased and granularity decreased. The highest level of speed was observed at 4M % epitaxy. When gamma normalized granularity was observed, the 6M % epitaxy sample exhibited the highest granularity while the 2M % epitaxy exhibited a −0.3 grain unit drop in granularity.

Example 6

This example demonstrates a speed-granularity and contrast advantage by reducing the M % epitaxy in an emulsion in which the host tabular grains exhibited a mean ECD of 7.4 μm and silver coating coverages were increased to 1.29 g/m$^2$ Ag.

A vessel equipped with a stirrer was charged with 40 L of water containing 160 grams of lime-processed, oxidized bone gelatin and 280 g of NaBr, at pH of 5.65 and 60° C. Nucleation was accomplished by a 6 sec. addition of 0.07M $AgNO_3$ in sufficient quantity to form 0.27 mol of silver bromide, pBr and pH remained approximately at the values initially set in the reactor solution. During the next 12.5 minutes a heat ramp to 75° C. and ammonia ripening with 0.36 mole of $NH_4OH$ occurred simultaneously with addition of 0.07M $AgNO_3$ at 65 mL/min. The reaction temperature was lowered to 70° C., pH was adjusted to 5.7, and 1 Kg of lime-processed, oxidized bone gelatin and 30 g of NaBr dissolved in 40 L of $H_2O$ were added to the reaction vessel. Twenty minutes after nucleation, the growth stage was begun during which 1.25M $AgNO_3$, 1.25M NaBr, and a suspension of 0.0477M AgI (Lippmann) were added in proportions to maintain a uniform iodide level of 3.0M % in the growing silver halide crystals and the reaction vessel pBr at the value resulting from the cited halide and $AgNO_3$ additions. This pBr was maintained until 37.6 moles of silver iodobromide were precipitated. At this point, no additional AgI suspension was added to the reactor, but growth continued at the same rate with 1.25M $AgNO_3$ and NaBr solutions to precipitate 2 moles AgBr as a shell. The resulting emulsion was washed by ultrafiltration, and pH and pBr were adjusted to storage values of 5.9 and 2.5, respectively.

Tabular Grains accounted for Greater than 95 percent of the total grain projected area. The mean ECD of the grains of this emulsion was 7.4 μm, and the mean tabular grain thickness was 0.09 μm.

Sensitization and sensitometry were identical to Examples 1–3, except for the variations stated at the beginning of this example. The photographic performance is summarized in Table VI.

TABLE VI

| Epitaxy (% ΣAg) | Relative Log Speed | Granularity (Δ GU) | Contrast |
|---|---|---|---|
| 6 | 100 | Ref. | 0.75 |
| 4.24 | 100 | 0 | 0.83 |
| 2 | 102 | −3.5 | 1.49 |

As the level of epitaxy declined, contrast increased. However, no increase in photographic speed or decrease occurred until the epitaxy was reduced below 4M %. At below 4M % epitaxy the contrast markedly increased. This demonstrates that for tabular Grain emulsions exhibiting mean ECD's of >5 μm it is preferred to limit to epitaxy to less than 4M % to realize maximum performance advantages.

Example 7

This example is similar to Example 6, except that the mean ECD of the tabular Grain emulsion was increased to 11.5 μm.

A reaction vessel equipped with a stirrer was charged with 4 L of water containing 16 Grams of lime-processed, oxidized bone gelatin and 28 G of NaBr, at pH of 5.65 and 60° C. Nucleation was accomplished by a 6 sec. addition of 0.07M $AgNO_3$ in sufficient quantity to form 0.00091 mol of silver bromide, pBr and pH remained approximately at the values initially set in the reactor solution. During the next 12.5 minutes, a heat ramp to 75° C. and ammonia ripening with 0.036 mole of $NH_4OH$ occurred simultaneously with addition of 0.07M $AgNO_3$ at 6.5 mL/min. The reaction temperature was lowered to 70° C., pH was adjusted to 5.7, and 100 g of lime-processed, oxidized bone gelatin and 3 g of NaBr dissolved in 4.0 L of $H_2O$ were added to the reaction vessel. Twenty minutes after nucleation, the growth stage was begun during which 1.25M $AgNO_3$, 1.25M NaBr, and a suspension of 0.0477M AgI (Lippmann) were added in proportions to maintain a uniform iodide level of 3.0M % in the growing silver halide crystals and to maintain pBr at the value resulting from the cited halide and $AgNO_3$ additions. This pBr was maintained until 3.76 moles of silver iodobromide were precipitated. At this point, no additional AgI suspension was added to the reaction vessel, but growth continued at the same rate with 1.25M $AgNO_3$ and NaBr solutions to form 0.2 mole of AgBr as a shell. The resulting emulsion was washed by ultrafiltration, and pH and pBr were adjusted to storage values of 5.9 and 2.5, respectively.

Tabular grains accounted for greater than 95 percent of the total grain projected area. The mean ECD of the grains of this emulsion was 11.5 μm, and the mean tabular grain thickness was 0.13 μm.

Sensitization and sensitometry were identical to Example 6. The photographic performance is summarized in Table VII.

TABLE VII

| Epitaxy (% ΣAg) | Relative Log Speed | Granularity (Δ GU) | Contrast |
|---|---|---|---|
| 4.25 | 100 | Ref. | 0.5 |
| 2 | 117 | −1.5 | 0.84 |
| 1 | 117 | −2 | 0.95 |

As the level of epitaxy declined, contrast and speed increased, while granularity decreased. Table VII demonstrates that for tabular grain emulsions exhibiting mean ECD's of >10 μm it is preferred to limit to epitaxy to less than 4M % to realize maximum performance advantages.

Example 8

This emulsion was prepared as follows: To a L solution containing 120 g of peroxide-treated gelatin in distilled water, 9.7 mL of a 1.67M aqueous $AgNO_3$ solution and 9.7 mL of a 1.67M aqueous solution containing NaBr and KI (1.5 mol %) were added at constant flow rate over a period of 7 sec with agitation and at pBr 2.3, pH 6 and 40° C. At the end of this nucleation, 1 L of a solution of 20 g of peroxide-treated gelatin in distilled water was added at 40° C. The temperature was then linearly increased to 45° C. over a period of 9 min, and then to 60° C. over a period of 9 min. A solution of 17.5 g of NaCl in 114 g of distilled water was then added, and the pBr was adjusted to 1.75 with a 1M aqueous NaBr solution.

A 0.4M aqueous $AgNO_3$ solution was then added at a constant flow rate of 66 mL/min over a period of 20 min with continuous agitation. During this time a suspension of 20 nmAgI particles, with a suspension density of 0.05 mol/L, containing 40 g/L peroxide-treated gelatin was simultaneously added at a constant flow rate of 7.9 mL/min, while the pBr was controlled at 1.75 with a 4.5M aqueous NaBr solution and the temperature was maintained at 60° C. The AgI suspension was previously prepared by conventional double-jet precipitation of $AgNO_3$ and KI in the presence of peroxide-treated gelatin. The pBr was then decreased to 1.5 by addition of the 4.5M aqueous NaBr solution, and the resulting tabular crystals were further grown as follows. The flow rate of the 0.4M $AgNO_3$ solution was linearly increased from 66 mL/min to 220 mL/min over a period of 60 min and the flow rate of the suspension was lenearly increased from 7.9 to 26.4 mL/min during this time, while the pBr was controlled at 1.5 with the 4.5M NaBr solution, and the temperature was maintained at 60° C. The resulting emulsion was washed using ultrafiltration.

Tabular grains accounted for greater than 95 percent of the total grain projected area. The mean ECD of the grains of this emulsion was 4.0 μm, and the mean tabular grain thickness was 0.047 μm.

Sensitization and sensitometry were identical to Example 1, except for the following variations: The ruthenium dopant was omitted from the epitaxy and the spectral sensitizing dyes were DYE-1 and DYE-3.

DYE-3

Anhydro-3,9-diethyl-3'-methyl-sulfonyl carbamoylmethyl-5-phenyloxathiocarbocyanine hydroxide No spectral sensitizing dyes were added in the postepitaxy sensitization. The coatings contained 0.54 g Ag/m$^2$, 0.97 g/m$^2$ COUP-1, and 2.58 g/m$^2$ gelatin. The antifoggant 4-hydroxy-6-methyl-1,3,3a,7-tetraazaindene was coated in the emulsion layer in the amount of 1.8 g per Ag mole. The emulsion layer was overcoated with a 1.6 g/m$^2$ gelatin layer containing the hardening agent bis(vinylsulfonylmethyl-)ether at a concentration of 1.75 wt. %, based on the total weight of gelatin. Samples of the emulsion receiving 4, 6 or 8M % epitaxy, based on total silver, are compared in Table VIII.

TABLE VIII

| Epitaxy (% ΣAg) | Relative Log Speed | Granularity (Δ GU) | Contrast |
|---|---|---|---|
| 8 | 100 | Ref | 1.01 |
| 6 | 105 | +0.1 | 1.22 |
| 4 | 109 | −1.9 | 1.57 |

As the level of epitaxy declined, contrast and speed increased. The lowest granularity was observed when the epitaxy was lowered to 4M % of total silver.

The invention has been described in detail with particular reference to preferred embodiments thereof, but it will be understood that variations and modifications can be effected within the spirit and scope of the invention.

What is claimed is:

1. A radiation-sensitive emulsion comprised of (1) a dispersing medium, (2) silver halide grains including tabular grains (a) having {111} major faces, (b) containing greater than 70 mole percent bromide and up to 10 mole percent iodide, based on silver, (c) accounting for greater than 90 percent of total grain projected area, and (d) having latent image forming chemical sensitization sites on the surfaces of the tabular grains, and (3) a spectral sensitizing dye adsorbed to the surface of the tabular grains, wherein (4) the surface chemical sensitization sites include epitaxially deposited silver halide protrusions of a face centered cubic rock salt crystal lattice structure forming epitaxial junctions with the tabular grains, the protrusions (a) being restricted to those portions of the tabular grains located nearest peripheral edges of and accounting for less than 10 percent of the {111} major faces of the tabular grains, (b) accounting for less than 5 percent of total silver forming the tabular grains and protrusions, (c) containing a silver chloride concentration at least 10 mole percent higher than that of the tabular grains, and (d) containing at least 1 mole percent iodide, based on silver in the protrusions, and (5) the tabular grains exhibit an average equivalent circular diameter of at least 3.5 μm.

2. A radiation-sensitive emulsion according to claim 1 wherein said tabular grains contain less than 6 mole percent iodide.

3. A radiation-sensitive emulsion according to claim 2 wherein said tabular grains contain less than 4 mole percent iodide.

4. A radiation-sensitive emulsion according to claim 1 wherein said protrusions contain from 1 to mole percent iodide.

5. A radiation-sensitive emulsion according to claim 4 wherein said protrusions contain from 2 to 10 mole percent iodide.

6. A radiation-sensitive emulsion according to claim 1 wherein said protrusions contain at least 15 mole percent higher chloride ion concentrations than said tabular grains.

7. A radiation-sensitive emulsion according to claim 6 wherein said protrusions contain at least 20 mole percent higher chloride ion concentrations than said tabular grains.

8. A radiation-sensitive emulsion according to claim 1 wherein said protrusions account for at least 1.0 percent of total silver.

9. A radiation-sensitive emulsion according to claim 1 wherein the mean equivalent circular diameter of the tabular grains is greater than 5 μm and said protrusions account for less than 4 percent of total silver.

10. A radiation-sensitive emulsion according to claim 1 wherein the epitaxially deposited silver halide protrusions are predominantly located adjacent at least one of the edges and corners of the tabular grains.

11. A radiation-sensitive emulsion according to claim 1 wherein the tabular grains have mean equivalent circular diameter of up to 15 μm.

12. A radiation-sensitive emulsion according to claim 1 wherein the tabular grains account for greater than 97 percent of total grain projected area.

13. A radiation-sensitive emulsion according to claim 1 wherein the tabular grains have a mean thickness of less than 0.2 μm.

14. A radiation-sensitive emulsion according to claim 13 wherein the tabular grains have a mean thickness of less than 0.07 μm.

15. A radiation-sensitive emulsion according to claim 1 wherein the spectral sensitizing dye exhibits an absorption peak at wavelengths longer than 430 nm.

16. A radiation-sensitive emulsion according to claim 15 wherein the spectral sensitizing dye is a J-aggregated cyanine dye.

* * * * *